US006277013B1

(12) United States Patent
Sasaki et al.

(10) Patent No.: US 6,277,013 B1
(45) Date of Patent: Aug. 21, 2001

(54) ELECTRIC POWER TOOL HAVING AN IMPROVED IMPACT CUSHIONING MECHANISM

(75) Inventors: Katsuhiko Sasaki, Aichi-ken; Toru Itakura, Toyota; Shin Sugiura, Anjo, all of (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/411,876

(22) Filed: Oct. 4, 1999

(30) Foreign Application Priority Data

Oct. 5, 1998 (JP) ..... 10-283069
Mar. 25, 1999 (JP) ..... 11-082338

(51) Int. Cl.[7] ..... B24B 7/00
(52) U.S. Cl. ..... 451/360; 451/344
(58) Field of Search ..... 451/360, 344; 248/573, 579, 580; 188/68, 69, 73.38; 192/144, 146, 147, 148, 150, 56.1, 56.2

(56) References Cited

U.S. PATENT DOCUMENTS 3,955,662 * 5/1976 Thackston ..... 192/150
4,467,896 * 8/1984 Sauerwein et al. ..... 188/69
4,579,201 * 4/1986 Tiedeman ..... 192/8 C

* cited by examiner

*Primary Examiner*—Timothy V. Eley
*Assistant Examiner*—Dung Van Nguyen
(74) *Attorney, Agent, or Firm*—Foley, Hoag & Eliot LLP

(57) ABSTRACT

A grinder 1 includes a spindle 9 having a small-diameter section 11 and a medium-diameter section 12 and a motor shaft 5 on which a pinion gear 6 is provided. The grinder 1 further includes a bevel gear 18 which is provided on the small-diameter section 11 of the spindle 9 and engages the pinion gear 6, and a lock sleeve 17 provided below the bevel gear 18 on the medium-diameter section 12. A coupling groove 21 is provided in the lower surface of the bevel gear 18 opposing the upper surface of the lock sleeve 17. The coupling groove 21 has an external diameter coaxial with and equal to the inner diameter of the lock sleeve 17 and further has an inner diameter coaxial with and equal to the external diameter of the medium-diameter section 12. An inner coil spring 22 is fitted around the second peripheral surface such that half the length of the coil spring covers the inner peripheral surface of the coupling groove 21, whereas the other half covers the outer peripheral surface of the medium-diameter section 12. In addition, an outer coil spring 23 is fitted around the first peripheral surface such that half the length of the coil spring covers the outer peripheral surface of the coupling groove 21, whereas the other half covers the inner peripheral surface of the lock sleeve 17. The grinder 1 additionally includes a gear housing 3 and a locking device 25 for locking the bevel gear 18.

20 Claims, 4 Drawing Sheets

ELECTRIC POWER TOOL HAVING AN IMPROVED IMPACT CUSHIONING MECHANISM

This application claims priority on Japanese Patent Application No. 10-283069 filed on Oct. 5, 1998 and Japanese Patent Application No. 11-82338 filed on Mar. 25, 1999, the contents of which are incorporated herein reference.

BACKGROUND OF THE INVENTION

1. Field of the Invention

The present invention relates to electric power tools, such as grinders, that transmit rotation of a motor via the motor shaft to a gear disposed coaxially with a spindle. More particularly, the present invention relates to an electric power tool such as described above that includes a mechanism for reducing impact on the tool during operation.

2. Description of the Related Art

A certain type of grinder includes a motor shaft having a gear at its free end and a spindle disposed orthogonally to the motor shaft in a housing. Another gear, such as a bevel gear, is secured to the spindle by suitable means, such as key-groove coupling or press fitting. The bevel gear on the spindle meshes with the gear of the motor shaft so as to transmit torque from the motor to spindle via the bevel gear. The grinding additionally includes a recess in a portion of the bevel gear where the teeth are not formed and a locking device that is biased in the direction away from the recess in the bevel gear. The locking device can be manually pushed into the recess for locking the spindle via the bevel gear in order to facilitate tightening and loosening of a lock nut that attaches, for example, a grinding wheel to the spindle.

When a locking device is used as a brake in a grinder with no electric brake, the tool bit, such as a grinding wheel, continues to rotate due to its own inertia even after the motor is turned off. Thus, if the operator wishes to quickly change the tool bit for a different task, the locking device is used as a brake by bringing the device into contact with the bevel gear. This, however, subjects not only the locking device but also the bevel gear, the spindle, and the housing to severe impact, which may cause deformation or breakage of these elements.

Moreover, as the lock nut tends to be tightened by the rotation of the grinder wheel, when the motor is started, the lock nut is subjected to an impact acting in the direction in which the nut is tightened. When electric brakes (if provided) are applied or the locking device is used as a brake during rotation of the tool bit due to its own inertia, a difference in rotational speed develops between the tool bit, which tends to stay in rotation due to its inertia, and the decelerating bevel gear and spindle. As this difference in speed generates an impact on the lock nut acting in the direction opposite to that in which the lock nut is tightened, the lock nut may be inadvertently loosened.

SUMMARY OF THE INVENTION

In view of the above-identified problems, an important object of the present invention is to provide an electric power tool that lessens impact on a locking device, gears, and other elements of the tool when the locking device is used as a brake.

Another object of the present invention is to provide an electric power tool that realizes a simple and effective structure for reducing clashing between gear teeth at the start of the motor and/or application of brakes.

Still another object of the present invention is to provide an electric power tool that, while reducing clashing between gear teeth, prevents unintended tightening and loosening of a nut, or screw, or bolt used to fasten a tool bit, such as a grinding wheel, to a spindle of the tool during operation.

Still another object of the present invention is to provide an electric power tool that reduces undesirable vibration of the motor shaft and further reduces clashing between gear teeth.

The above objects and other related objects are realized by the invention, which provides an electric power tool including: a motor having a motor shaft; a spindle; a gear disposed coaxially with a spindle for transmitting rotation of the motor shaft to the spindle such that the spindle is freely rotatable relative to the gear; a lock means for preventing rotation of the gear; a first ring-shaped peripheral surface provided in the spindle; a second ring-shaped peripheral surface provided in the gear, the second peripheral surface being coaxial with the first peripheral surface; and a first coil spring disposed in contact with the first and second ring-shaped peripheral surfaces so as to connect the gear and the spindle. In this electric power tool, a difference in speed between the gear and the spindle due to a decrease in the rotational speed of the gear generates a force that causes the first coil spring to change its diameter so as to transmit a braking force applied from the gear to the spindle.

According to one aspect of the present invention, the first ring-shaped peripheral surface is connected to the second ring-shaped peripheral surface such that the two surfaces define a first continuous circular surface. Furthermore, the first and second ring-shaped peripheral surfaces have the same diameter and are coaxial with the spindle and the gear.

According to another aspect of the present invention, the first continuous circular surface is an inwardly circular surface relative to the center thereof. Furthermore, the first coil spring has an outer diameter slightly larger than the diameter of the first continuous circular surface and is fitted in the first continuous circular surface such that the expanding force of the first coil spring connects the gear and the spindle.

According to still another aspect of the present invention, the midpoint of the first coil spring is located at the connection of the first and second ring-shaped peripheral surfaces, such that half the winding of the first coil spring covers the first ring-shaped peripheral surface and the other half of the winding covers the second ring-shaped peripheral surface.

According to yet another aspect of the present invention, the first coil spring may have an approximately square cross section.

In one embodiment, the electric power tool further includes a third ring-shaped peripheral surface provided in the spindle and a fourth ring-shaped peripheral surface provided in the gear. The third peripheral surface is coaxial with the first and second peripheral surfaces and has a diameter differing from that of either the first or second peripheral surface, whereas the fourth peripheral surface is coaxial with the third peripheral surface and has the same diameter as that of the third peripheral surface. The tool additionally includes a second coil spring which is coaxial with the first coil spring and disposed in contact with the third and fourth ring-shaped peripheral surfaces so as to connect the gear and the spindle such that a difference in speed between the gear and the spindle due to an increase in the rotational speed of the gear causes the first coil spring to change its diameter so as to transmit rotation of the gear to the spindle.

In one aspect, the third ring-shaped peripheral surface is connected to the fourth ring-shaped peripheral surface such that the two surfaces define a second continuous circular surface.

In another aspect, the second continuous circular surface is an outwardly circular surface relative to the center thereof, whereas the second coil spring has an inner diameter slightly smaller than the diameter of the second continuous circular surface and is wound around the second continuous circular surface, such that the winding force of the second coil spring connects the gear and the spindle.

In still another aspect, the midpoint of the second coil spring is located at the connection of the third and fourth ring-shaped peripheral surfaces, such that half the winding of the second coil spring covers the third ring-shaped peripheral surface and the other half of the winding covers the fourth ring-shaped peripheral surface.

In yet another aspect, the second coil spring has an approximately square cross section.

According to one aspect, the electric power tool further includes a circular groove which is provided in the gear and the spindle and has inner and outer peripheral surfaces coaxial with the gear and the spindle, with the outer peripheral surface being the first continuous circular surface and the inner peripheral surface being the second continuous circular surface.

According to another aspect, the tool is a grinder further comprising a housing and a grinding wheel attached to a free end of the spindle outside the housing.

The invention is also directed to an electric power tool which includes: a motor having a motor shaft which is rotatable in a predetermined direction and includes a first section; a first gear freely rotatably provided on the motor shaft, the first gear including a gear shaft which coaxially opposes the first section of the motor shaft and which has approximately the same diameter as that of the first section; a second gear provided on a spindle, the second gear engaging the first gear is order to transmit torque from the motor to the spindle; and a coil spring wound around the first section of the motor shaft and the gear shaft of the first gear, the coil spring being wound in the direction opposite to the rotational direction of the motor shaft such that the coil spring transmits torque between the motor shaft and the first gear.

In one aspect, the coil spring has an inner diameter slightly smaller than the diameter of the first section of the motor shaft and the gear shaft of the first gear such that the first section is connected to the gear shaft by the winding force of the coil spring while the motor is inoperative.

Furthermore, the motor shaft further may include a free end and a second section which has a diameter smaller than that of the first section and is terminated at the free end, whereas the first gear further includes an axial bore having approximately the same inner diameter as the diameter of the second section of the motor shaft so as to allow the first gear to be freely rotatably provided around the second section of the motor shaft at the free end of the motor shaft.

In accordance with another aspect of the present invention, the first gear further includes a tooth section having a diameter larger than that of the gear shaft, whereas the tool further includes a means for limiting movement of the coil spring is one axial direction of the spring, the coil spring fitted between the limiting means and the tooth section, thus prohibiting the axial movement of the coil spring in either direction.

The electric power tool may further include: a housing; a bearing for supporting the motor shaft, the bearing having an outer surface and being disposed in a portion of the housing; a cylindrical elastic ring which is disposed between the bearing and the aforementioned portion of the housing and which includes an inner surface and at least one protrusion provided on the inner surface, with the at least one protrusion pressing the outer surface of the bearing when the elastic ring is disposed in place.

In one aspect, the at least one protrusion of the elastic ring is a circular ridge formed around the inner surface of the elastic ring.

In another aspect, the portion of the housing is a stepped recess for seating the elastic ring and the bearing.

In still another aspect, the housing includes first and second casings divided at a position where the stepped recess is exposed, with the stepped recess being provided in the first casing and the second casing covering the stepped recess except where the motor shaft penetrates when assembled to the first casing.

In yet another aspect, the first gear is a pinion gear and the second gear is a bevel gear, whereas the motor shaft is oriented orthogonal to the spindle.

In one practice, the tool is a grinder further including a grinding wheel attached to a free end of the spindle outside the housing.

In another practice, the means for limiting is a side surface of the bearing.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENTS

The preferred embodiment according to the present invention will be described hereinafter with reference to the attached drawings.

First Embodiment

Figure 1:
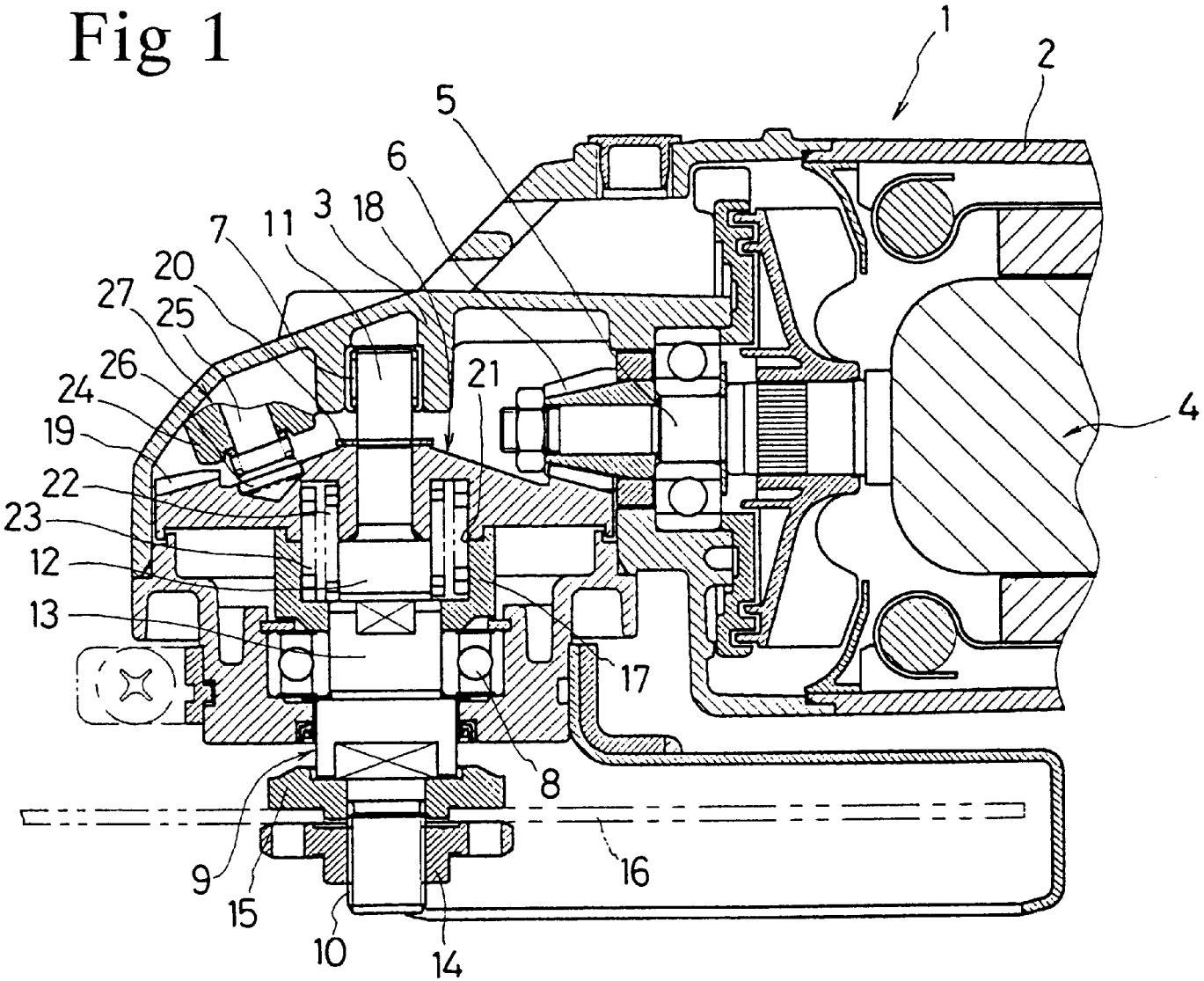
FIG. 1 is a partial cross section of an essential part of an electric power grinder of the present invention.

FIG. 1 is a partial cross section of an essential part of an electric power grinder 1 according to the present invention. The grinder 1 includes a motor 4 encased within a motor housing 2. The motor 4 in turn includes a motor shaft 5 which protrudes forward (to the left as seen in FIG. 1) into a gear housing 3 provided in front of the motor housing 2. A pinion gear 6 is secured to the top end of the motor shaft 5. A spindle 9 is disposed orthogonally to the motor shaft 5 in front of the motor housing 2 within the gear housing 3, with its upper end supported by a needle bearing 7 and its intermediate portion supported by a ball bearing 8. Furthermore, the lower end of the spindle 9 is formed with external threads 10 and protrudes downward out of the gear housing 3. An inner flange 15 is tightly fitted around the spindle 9 outside of the gear housing 3 above the external threads 10, on which a lock nut 14 is tightened. A tool bit, such as a grinding wheel 16, can be secured between the inner flange 15 and the lock nut 14 by tightening the nut 14 on the external threads 10.

The spindle 9 has a multiple diameter structure, including a small-diameter section 11, a medium-diameter section 12, and a large-diameter section 13 (the above-described intermediate portion) from its upper end toward its lower end, respectively. A lock sleeve 17 is coaxially fitted on two opposing flat faces of the large-diameter section 13 above the ball bearing 8 so as to rotate integrally with the spindle 9. A bevel gear 18 having teeth 19 is freely rotatably provided on the small-diameter section 11. The teeth 19 of the bevel gear 18 engage the pinion gear 6 of the motor shaft 5. Furthermore, a clip 20 is fitted on the upper surface of the bevel gear 18 around the small-diameter section 11 so as to tightly interpose the bevel gear 18 between the clip and the medium-diameter section 12, thus prohibiting any axial sliding of the bevel gear 18.

Figure 2:
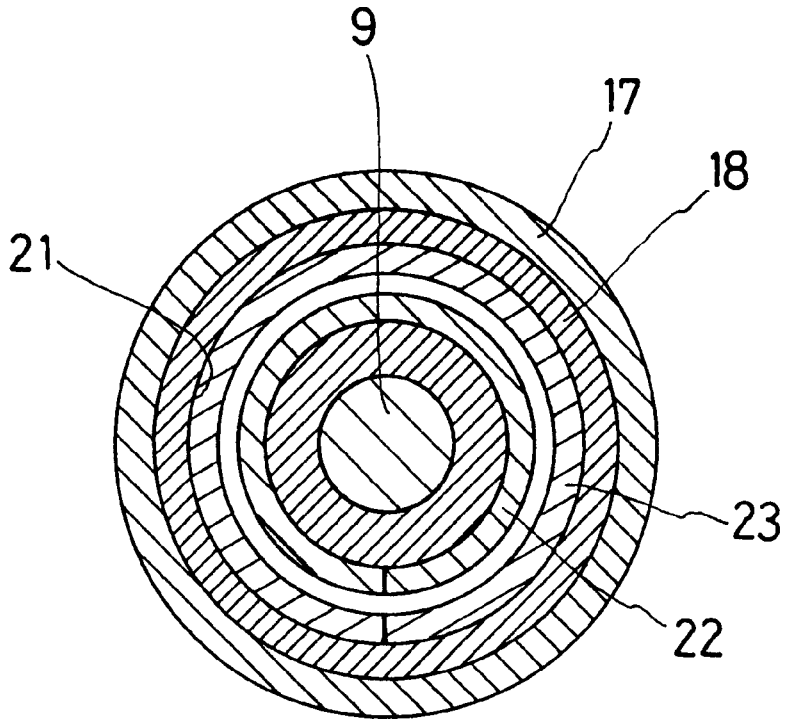
FIG. 2 is a horizontal cross section of a spindle of the grinder shown in FIG. 1 around which an outer coil spring and an inner coil spring are concentrically fitted.

A ring-shaped (circular) coupling groove 21 is provided in the lower surface of the bevel gear 18 opposing the upper surface of the lock sleeve 17. The coupling groove 21 has an external diameter coaxial with and equal to the inner diameter of the lock sleeve 17 and further has an inner diameter coaxial with and equal to the external diameter of the medium-diameter section 12. As can be seen in FIGS. 1 and 2 and understood from the foregoing description, the outer peripheral surface of the coupling groove 21 and the inner peripheral surface of the lock sleeve 17 define a continuous first peripheral surface, whereas the inner peripheral surface of the coupling groove 21 and the outer peripheral surface of the medium-diameter section 12 define a continuous second peripheral surface. As shown in the drawings, an inner coil spring 22 is fitted around the second peripheral surface such that half the length (winding) of the coil spring covers the inner peripheral surface of the coupling groove 21, whereas the other half covers the outer peripheral surface of the medium-diameter section 12. In addition, an outer coil spring 23 is fitted around the first peripheral surface such that half the length (winding) the coil spring covers the outer peripheral surface of the coupling groove 21, whereas the other half covers the inner peripheral surface of the lock sleeve 17. Each of the inner and outer coil springs 22 and 23 is wound counterclockwise and has an approximately square cross section. The inner diameter of the inner coil spring 22 is made slightly smaller than the inner diameter of the coupling groove 21 and the outer diameter of the medium-diameter section 12, whereas the outer diameter of the outer coil spring 23 is made slightly larger than the outer diameter of the coupling groove 21 and the inner diameter of the lock sleeve 17. Accordingly, when the motor 4 is inoperative, the bevel gear 18 is connected to the medium-diameter section 12 of the spindle 9 by the winding force of the inner coil spring 22 and is additionally connected to the lock sleeve 17 by the expanding force of the outer coil spring 23.

Provided in the upper portion of the gear housing 3 above the left side of the bevel gear 18 is a cylindrical portion 24 which accommodates a locking member 25 slidable to the bevel gear 18. In addition, a compression spring (not shown) fitted around the locking member 25 urges the locking member upward and away from the bevel gear 18 (as shown in FIG. 1) such that the locking member 25 is out of contact with the bevel gear teeth 19. A recess 26 which can be engaged by the lower end of the locking member 25 is provided in the upper surface of the bevel gear 18 inside the teeth 19, which together with the locking member 25 constitutes a lock means 27 for locking the bevel gear 18.

It should be noted that the motor shaft 5 rotates clockwise relative to the perspective from the stator position, the bevel gear 18 rotates clockwise when viewed from the overhead perspective, and the lock nut 14 is tightened clockwise on the external threads 10 of the spindle 9.

In the operation of the grinder 1 thus constructed, when the motor shaft 5 starts rotation upon actuation of the motor 4, the pinion gear 6 and subsequently the bevel gear 18 also start rotating in the clockwise direction when viewed from the overhead perspective. This twists the inner coil spring 22 more tightly due to the friction between the spring and the inner peripheral surface of the coupling groove 21 currently set in rotation and the friction between the spring and the outer peripheral surface of the medium-diameter section 12, which tends to be stationary due to its inertia. This results in an increase in the winding force of the coil spring 22, thus firmly connecting the bevel gear 18 and the medium-diameter section 12. Subsequently, the spindle 9 starts rotating together with the bevel gear 18 in the clockwise direction when viewed from the overhead perspective. Due to this action of the coil spring 22 at the start of the operation, no sudden transmission of torque from the bevel gear 18 to the spindle 9 occurs. This cushioning effect exerted by the inner coil spring 22 lessens the clashing between the gears 6 and 18, thereby minimizing unpleasant noises, wear, deformation, and breakage of the gears.

At the actuation of the motor 4, the outer coil spring 23 is twisted tightly due to the friction between the spring and the outer peripheral surface of the coupling groove 21 and the friction between the spring and the inner peripheral surface of the lock sleeve 17. This significantly decreases the expanding force of the outer coil spring 23 so that the spring 23 transmits substantially no torque from the motor 4 to the spindle 9. Also at the actuation of the motor 4, a force acting to tighten the lock nut 14 is generated by the friction between the lock nut and the grinding wheel 16, which rotates following the rotation of the spindle 15.

After the motor 4 is switched off, the grinding wheel 16 and the spindle 9 continue to rotate for a short while due to their inertia. If the operator pushes the locking member 25 of the lock means 27 down into contact with the bevel gear 18, it reduces the rotational speed of the bevel gear, causing a difference in speed between the bevel gear 18 and the spindle 9. This in turn causes the outer coil spring 23 to expand due to the friction between the spring and the outer peripheral surface of the coupling groove 21 and the friction between the spring and the inner peripheral surface of the lock sleeve 17. The increased expanding force of the spring 23 connects the bevel gear 18 and the lock sleeve 17, such that the grinding wheel 16 and the spindle 9 decrease their rotational speed in response to the deceleration of the bevel gear. When the locking member 25 is fitted into the recess 26 of the bevel gear 18 so as to stop the bevel gear, the grinding wheel 16 and the spindle 9 also stop at the same time. As described above, during the transmission of the braking force, a short time lag occurs due to the expansion of the coil spring 23 from the time when the difference in speed develops between the bevel gear 18 and the spindle 9 to the time when the spindle 9 begins to respond. This means that the cushioning effect provided by the outer coil spring 23 lessens the impact on the locking member 25, the bevel gear 18, and the gear housing 3. Additionally, during the acceleration of the spindle 9, a force acting to loosen the lock nut 14 is generated due to the inertia of the tool bit 16. However, as the cushioning effect of the outer coil spring 23 also alleviates the transmission of the impact from the grinding wheel 16 to the lock nut 14, the lock nut remains properly tightened.

In order to loosen the lock nut 14 for removal of the grinding wheel 16 when the motor 4 is inoperative, the locking member 25 is pushed down to lock the bevel gear 18. The lock nut 14 is then rotated counterclockwise relative to the spindle 9. However, the rotation of the lock nut 14 generates a force that also causes the spindle 9 and the lock sleeve 17 to rotate counterclockwise relative to the locked bevel gear 18. This rotation in turn causes friction between the outer coil spring 23 and the outer peripheral surface of the coupling groove 21 and friction between the spring 23 and the inner peripheral surface of the lock sleeve 17, thus generating a force that causes the outer coil spring 23 to expand. Accordingly, the increased expansion of the spring 23 connects the bevel gear 18 and the lock sleeve 17. This allows rotation of only the lock nut 14, and thus its removal from the external threads 10, thereby permitting replacement of the grinding wheel 16.

Conversely, in order to tighten the lock nut 14, the locking member 25 is pushed down to lock the bevel gear 18. The lock nut 14 is then tightened on the external threads 10, generating a force that causes the spindle 9 and the lock sleeve 17 to rotate clockwise relative to the locked bevel gear 18. This rotation causes friction between the inner coil spring 22 and the inner peripheral surface of the coupling groove 21 and friction between the spring 22 and the outer peripheral surface of the medium-diameter section 12, thus generating a force that tightly twists the spring 22 and firmly connects the bevel gear 18 and the medium-diameter section 12. This allows rotation of only the lock nut 14, and thus tightening of the lock nut on the external threads 10.

As described above, according to the first embodiment, the inner coil spring 22 and the outer coil spring 23 connect the bevel gear 18 to the spindle 9 so as to effectively alleviate impacts on the locking member 25, the bevel gear 18, and the gear housing 3 when the spindle 9 is locked. This means the arrangement of this embodiment can prevent deformation and damage to the locking member 25 and the teeth 19 of the bevel gear 18.

The inner coil spring 22 also prevents abrupt transmission of torque at the actuation of the grinder 1; the coil spring 22 produces a cushioning effect to lessen noise from gear clashing and wear of the pinion gear.

Although the electric power grinder 1 does not incorporate any electric brake, the structure of this embodiment is equally applicable to grinders having an electric brake. That is, when an electric brake is applied to stop rotation of the spindle and the tool bit in a grinder having an electric brake, the structure can also prevent abrupt transmission of torque and produce a cushioning effect in substantially the same manner as described above (when the locking member 25 is pushed down into contact with the bevel gear 18 while the spindle 9 is rotation due to its inertia). Whether an electric brake or a locking member is used, the bevel gear 18 decelerates with the decelerating motor shaft 5 while the lock sleeve 17 continues to rotate by its inertia. This causes the outer coil spring 23 to expand, thus rapidly stopping the spindle 9 and the grinding wheel 16.

In a grinder having an electric brake as well, a force acting to loosen the lock nut 14 is generated due to the inertia of the tool bit 16 during the deceleration of the spindle 9. However, as the cushioning effect of the outer coil spring 23 also alleviates the transmission of the impact from the grinding wheel 16 to the lock nut 14 in the same manner as in the first embodiment, the lock nut remains properly tightened.

In the first embodiment, the inner coil spring 22 is used for torque transmission at the actuation of the electric power grinder 1, whereas the outer coil spring 23 is used for torque transmission upon application of brakes. It should be noted that the functions of the coil springs can be reversed by winding the springs clockwise.

In the first embodiment, one coil spring (the inner coil spring 22) is wound around the inner peripheral wall of the coupling groove 21 and another (the outer coil spring 23) is fitted on the outer peripheral wall of the coupling groove. Alternatively, an intermediate coaxial wall may be provided between the inner and outer peripheral walls in the coupling groove 21 such that the two coil springs can be wound around two peripheral wall surfaces in opposite directions. In this way, one of the coil springs can be used for transmission of torque at the actuation of the electric power grinder 1, while the other coil spring can be used for the same purpose upon application of brakes. However, as an important objective of the first embodiment is to cushion impacts during brake application, a coil spring need not be used for torque transmission at the start of operation, i.e., at the actuation of the motor 4. Instead, a claw clutch, ratchet, or other suitable device may be used as long as such a device can transmit torque from the motor to the spindle.

Moreover, the spindle need not be oriented orthogonal to the motor shaft as in the embodiment; it should be noted that the present embodiment is equally applicable to the structure is which torque is transmitted from a motor shaft to a spindle parallel to the motor shaft by means of a spur gear or other suitable means.

The structure of the first embodiment can lessen impact on the locking device, gearing, housing, and other elements of the electric power tool when the locking device is used as brakes, thus effectively preventing deformation and/or damage to these elements upon application of brakes. If a lock nut is employed, as in the embodiment, to secure a tool bit to a free end of the spindle, the foregoing structure can also prevent loosening of the lock nut. Moreover, a second coil spring provided for transmitting rotation of the motor to the spindle can lessen impact on the above-described elements of the electric power tool at the start of the tool/motor.

Second Embodiment

An alternate embodiment will be described hereinafter with reference to FIGS. 2 and 3.

As described above, the structure of the first embodiment effectively cushions impact during motor start-up by the use of one of the coil springs to transmit the actuating force and creates the same effect during brake application by the use of the other spring to transmit the braking force. However, in order to minimize the loosening of the lock nut, the coil spring used for transmitting the actuating force must be stronger than that used for transmitting the braking force. Striking a proper balance of tension between the two coil springs can be a delicate and difficult task; inaccurate tension setting may prevent the lock nut from being loosened, even when the second gear is fixed by the locking device. Additionally, the cost and the number of manufacturing steps is increased by the use of two coil springs and the associated design changes so as to accommodate the springs.

In view of the foregoing, the second embodiment provides an electric power tool having a simpler and equally effective structure.

Figure 3:
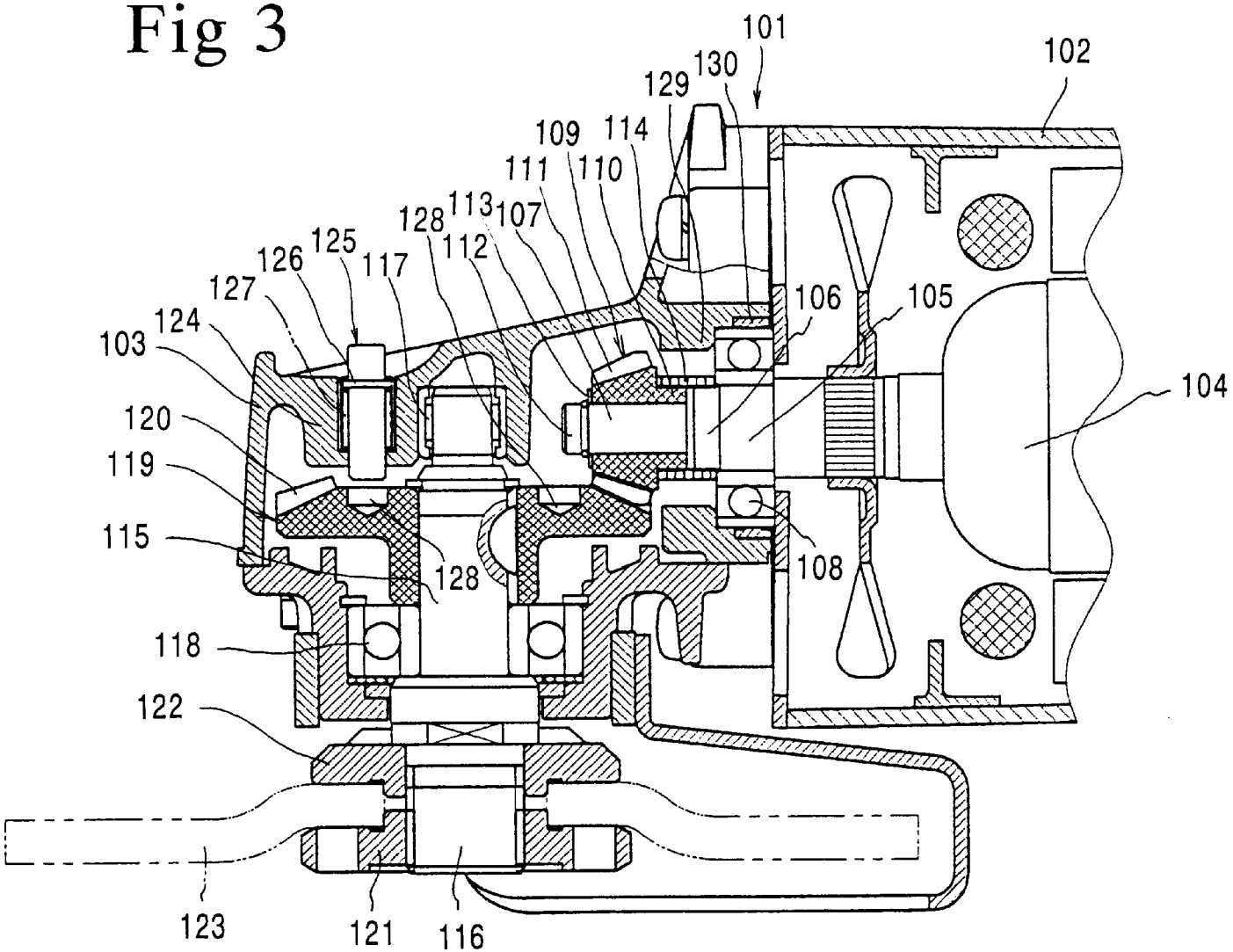
FIG. 3 is a partial cross section of an essential part of an alternate embodiment according to the present invention.

FIG. 3 is a partial cross section of an essential part of an electric power grinder 101 according to the present invention. The grinder 101 includes a motor 104 (provided with an electric brake) encased within a motor housing 102. The motor 104 in turn includes a motor shaft 105 which protrudes forward (to the left as seen in FIG. 3) into a gear housing 103 provided in front of the motor housing 102. The motor shaft 105 is supported by a ball bearing 108 provided at the position where the motor housing 102 is connected to the gear housing 103. The motor shaft 105 includes a large-diameter section 106 and a small-diameter section 107 between the ball bearing 108 and the top end of the shaft 105. A first gear 109, which may be a pinion gear or other type of gear, is freely rotatably fitted around the small-diameter section 107 and prevented by a bolt 112 and a washer 113 from slipping off the section 107. The pinion gear 109 includes teeth 111 and a shaft 110 which has the same diameter as that of the large-diameter section 106. Additionally, a coil spring 114 having a square cross section is wound around the large-diameter section 106 of the motor shaft 105 and the shaft 110 of the pinion gear 109 such that half the length of the coil spring covers the large-diameter section 106 and the other half covers the shaft 110. In the preferred embodiment, the coil spring 114 has an approximately uniform cross-section across its longitudinal axis, as shown in FIG. 3. The coil spring 114 is wound counter-clockwise as seen from the motor 104. As its diameter is made slightly smaller than that of the large-diameter section 106 and the shaft 110, the large-diameter section 106 is connected to the shaft 110 by the winding force of the coil spring 114 when the motor 104 is not activated. In addition, as the coil spring 114 is prohibited from moving axially as it is fitted between the ball bearing 108 and the teeth 111 of the pinion gear 109, the amount of the spring 114 wound around the large-diameter section 106 does not change regardless of the operating condition. The motor shaft 105 of this embodiment rotates in the clockwise direction relative to the perspective from the stator.

Provided in front the motor shaft 105 within the gear housing 103 is a spindle 115 which is supported orthogonally with respect to the motor shaft 105 by a needle bearing 117 at its upper end and a ball bearing 118 in an intermediate position. A second gear or bevel gear 119 with teeth 120 is key-connected to an intermediate position of the spindle 115 so as to rotate integrally with the spindle. The teeth 120 of the bevel gear 119 mesh with the teeth 111 of the pinion gear 109. Furthermore, the lower end of the spindle 115 is formed with external threads 116 and protrudes downward out of the gear housing 103. An inner flange 122 is tightly fitted around the spindle 115 outside of the gear housing 103 above the external threads 116 on which a lock nut 121 is tightened. A tool bit, such as a grinding wheel 123, can be secured between the inner flange 122 and the lock nut 121 by tightening of the nut 121 on the external threads 116. It should be noted that the lock nut 121 is tightened on the external threads 116 in the clockwise direction.

Provided in the upper portion of the gear housing 103 above the left side of the bevel gear 119 is a cylindrical bore 124 which accommodates a slidable locking member 125 extending parallel to the spindle 115. The locking member 125 is provided with a flange 126 which interferes with the opening of the cylindrical bore 124 so as to prevent the locking member 125 from slipping out of the bore 124. In addition, a coil spring 127 fitted around the locking member 125 below the flange 126 urges the locking member upward to its uppermost position (shown in FIG. 3), where the locking member is out of contact with the bevel gear 119. A plurality of recesses 128 which can be engaged by the lower end of the locking member 125 are provided in the upper surface of the bevel gear 119 inside the teeth 120. Therefore, to loosen the lock nut 121 for removal of the grinding wheel 123 when the motor 104 is turned off, the locking member 125 is pushed down in order to engage one of the recesses 128 of the bevel gear 119. This locks the spindle 115 as well as the bevel gear 119, allowing the operator to rotate and remove the lock nut 121 from the external threads 116 so as to, for example, replace the tool bit 123. The engagement of the locking member 125 with a recess 128 can be also used to tighten the lock nut 121.

Figure 4:
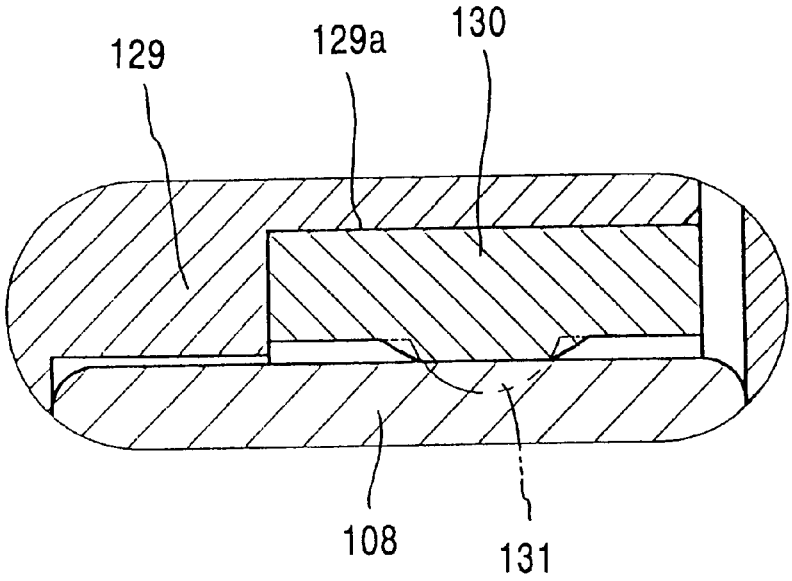
FIG. 4 is a partial cross section of an elastic ring fitted between a bearing box and a ball bearing of the electric power grinder of FIG. 3.

The ball bearing 108, which supports the motor shaft 105, is tightly fitted into a bearing box 129 formed at the rear end of the gear housing 103. As better shown in FIG. 4, a cylindrical elastic ring 130 whose side wall has a rectangular cross section is interposed between the bearing box 129 and the ball bearing 108. The elastic ring 130 is accommodated in a recess 129*a* which is provided at the rear end of the bearing box 129, forming a step-shaped cross section. When in place, a ridge 131 provided around the center of the inner wall of the elastic ring 130 presses the outer wall of the ball bearing 108, thus elastically supporting the ball bearing.

In the operation of the grinder 101 thus constructed, when the motor shaft 105 starts rotation upon activation of the motor 104, the coil spring 114 is twisted more tightly due to the friction between the spring and the peripheral surface of the large-diameter section 106 currently set in rotation and the friction between the spring and the shaft 110 of the stationary pinion gear 109. This results in an increase in the winding force of the coil spring 114 on the large-diameter section 106 and the shaft 110, thus firmly connected the large-diameter section and the shaft. Thus, the pinion gear 109 also starts to rotate clockwise with the motor shaft 105, subsequently rotating the bevel gear 119 in the clockwise direction when viewed from the overhead perspective. This in turn causes clockwise rotation of the spindle 115, to which the bevel gear 119 is secured, and of the grinding wheel 123. Due to this action of the coil spring 114 at the start of the operation, no sudden transmission of torque from the motor shaft 105 to the pinion gear 109 and to the bevel gear 119 occurs. This cushioning effect exerted by the coil spring 114 lessens the impact between the teeth 111 and 120, thereby minimizing unpleasant noises, wear, deformation, and breakage of the gears. At the start of activation of the motor 104, a force acting to tighten the lock nut 121 generated by the friction between the lock nut and the grinding wheel 123, which rotates following the rotation of the spindle 115. However, the cushioning effect of the coil spring 114 also alleviates the impact on the lock nut 121, preventing excessive tightening of the lock nut.

When the motor 104 is switched off, the electric brake applies braking force to the motor shaft 105. Despite application of this force, the grinding wheel 123, the spindle 115, and the bevel gear 119 tend to maintain their rotation due to inertia. As the pinion gear 109, in mesh with the bevel gear 119, behaves in the same manner, a difference in speed develops between the pinion gear 109 and the motor shaft 105. A force loosening the winding of the coil spring 114 develops due to the friction between the spring and the peripheral surface of the large-diameter section 106 and the friction between the spring and the peripheral surface of the shaft 110. This results in a decrease in the winding force of the spring 114 on the large-diameter section 106 and the shaft 110, thus reducing the transmission of the braking force to the pinion gear 109. Therefore, the pinion gear 109 smoothly rotates with the bevel gear 119 without clashing.

Subsequently, the rotational speed of the pinion gear 109 decrease along with that of the bevel gear 119, the spindle 115, and the grinding wheel 123, thus gradually restoring the winding force of the coil spring 114. When the pinion gear 109 and the motor shaft 105 eventually rotate at the same speed, the winding force of the coil spring 114 transmits the braking force from the motor shaft 106 to the pinion gear 109, subsequently stopping the rotation of the spindle 115 and the grinding wheel 123 when the motor shaft 105 stops its rotation.

As described above, there is a short time lag during the transmission of braking force from the motor shaft 105 to the pinion gear 109 from the time the difference in speed develops between the motor shaft 105 and the pinion gear 109 to the moment when the pinion gear 109 begins to respond. That is, the cushioning effect of the coil spring 114 lessens the impact between the teeth 111 and 120, thereby minimizing unpleasant noises, wear, deformation, and breakage of the gears. During the deceleration of the spindle 115, a force acting to loosen the lock nut 121 is generated due to the inertia of the tool bit 123. However, as the cushioning effect of the coil spring 114 also alleviates the transmission of the impact from the grinding wheel 123 to the lock nut 121, the lock nut remains properly tightened.

This cushioning effect is also produced by the coil spring 114 when the grinding wheel 123 or other attached tool is subjected to a sudden increase in load during rotation or when the locking member 125 is inadvertently pushed down to the bevel gear 119 during operation. More particularly, in either of the two cases, the rotational speeds of the bevel gear 119 and the pinion gear 109 decrease relative to that of the motor shaft 105, such that the coil spring 114 is twisted more tightly due to the friction between the spring and the peripheral surface of the large-diameter section 106 and the friction between the spring and the peripheral surface of the shaft 110. However, the large-diameter section 106 of the motor shaft 105 then rotates against the winding force of the coil spring 114, such that the spring slips on the peripheral surface of the large-diameter section 106. As a result, the above-described impact does not reach the motor shaft 105, thus preventing a kickback caused by the impact load, and lessening unpleasant noises, wear, deformation, and breakage of the gears 111 and 120.

This cushioning effect is available for electric power tools which include no electric brake but include a locking device (such as the locking member 125) that is used as a brake on a rotating tool bit (such as the grinding tool 123) when the device is pushed down into contact with the tool bit.

According to the foregoing embodiment, as the pinion gear 109 is freely rotatably provided relative to the motor shaft 105, with the coil spring 114 transmitting torque between these two elements, clashing between the gears 111 and 120 is effectively reduced so as to minimize unpleasant noises, wear, deformation, and breakage of the gears. In addition, this structure prevents tightening and loosening of the lock nut 121 throughout the operation of the grinder 101, including the start and the termination of the operation. The cushioning effect produced by the coil spring 114 is also effective for prevention of kickbacks caused by impact loads that develops during operation.

Furthermore, as the cushioning effect is achieved by the action of the coil spring 114 even when the spindle 115 is locked by the locking member 125, the bevel gear 119 can remain securely coupled to the spindle 115 by a key-groove connection. This unique structure of the present invention offers an additional advantage of permitting smooth and trouble-free replacement of the attached tool bit.

According to the embodiment, as the coil spring 114 is fitted over the connection between the motor shaft 105 and the pinion gear 109, in contrast to the arrangement in the previous embodiment, only one coil spring is required to achieve the aforementioned cushioning effect. In the structure of the first embodiment, two coil springs are required, with one of the two coil springs functioning during activation and the other during braking. Moreover, the structure according to the first embodiment requires determination of a proper balance between the tension set in each of the two springs during assembly. The simpler and equally effective structure of the present embodiment contributes to reduction in cost and productivity.

The second embodiment employs an elastic ring 130 having a ridge 131 which provides a more effective cushioning for the motor shaft 105 than a similar elastic ring without a ridge. The cushioning provided by the ridge 131 on the ring 130 prevents undesirable vibration of the motor shaft. Since the pinion gear 109 is fitted on the top end of the motor shaft 105, the cushioning provided by the ridge 131 is also effective for the prevention of vibration of the pinion gear 109, thus augmenting the cushioning of impact and prevention of noise achieved by the coil spring 114.

According to the second embodiment, as the recess 129*a* for accommodating the elastic ring 130 is provided at the rear end of the bearing box 129, the shape of the recess 129*a* can be incorporated in the molding of the gear housing 103, thus eliminating a step of machining such a recess for accommodating an O-ring at the center of the bearing box as required in the manufacture of conventional grinders. This additionally reduces the cost and the number of manufacturing steps of the grinder.

According to the second embodiment, the coil spring is wound counterclockwise, whereas the motor shaft rotates clockwise. If the rotational direction of the motor shaft is reversed, so must be the winding of the coil spring. It should be noted that the spindle need not be oriented orthogonal to the motor shaft as in the embodiment; the present invention is equally applicable to a structure in which torque is transmitted from a motor shaft to a spindle parallel to the motor shaft by means of a spur gear or other suitable means.

Additionally, a plurality of ridges 131 may be disposed on the elastic ring 130 and/or the shape of the ridge may be changed as long as such structure is provided on the inner surface of the elastic ring 130 so as to press the ball bearing 108 when in place. For example, instead of the ridge 131, one or more rows of protrusions may be provided on the inner surface of the elastic ring 130. Such a ridge or ridges, or a row or rows of protrusions, may be disposed further forward along the axis of the elastic ring 130 than the ridge 131 of the embodiment, for example, at the axial center of the outer surface of the bearing 108.

According to the second embodiment, as a coil spring couples a freely rotatable first gear to a motor shaft, the spring effectively reduces the clash between the first gear and a second gear engaging the first gear, thus preventing unpleasant noises, wear, deformation, and breakage of the gears. The cushioning effect realized by the coil spring is also effective for reduction in impact loads on the tool in rotation and thus prevention of kickbacks.

According to the second embodiment, only one coil spring is required to achieve the aforementioned effects as it is fitted over the joint between the motor shaft and the first gear. This feature contributes to reduction in cost and productivity by simplifying the structure and the assembly of the tool.

Moreover, additional cushioning is available for the motor shaft and the first gear by providing a protrusion on an elastic interposed between the bearing of the motor shaft and the portion of the housing seating the bearing such that the protrusion presses the outer surface of the bearing. This feature not only prevents vibrations of the motor shaft but also adds to the prevention of clashes and noises by the coil spring.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. An electric power tool, comprising:

a motor having a motor shaft which is rotatable in a predetermined direction and includes a first section;

a first gear freely rotatably provided on the motor shaft, the first gear including a gear shaft which coaxially opposes the first section of the motor shaft and which has approximately the same diameter as that of the first section;

a second gear provided on a spindle, the second gear engaging the first gear in order to transmit torque from the motor to the spindle; and a coil spring wound around the first section of the motor shaft and the gear shaft of the first gear, the coil spring having an approximately uniform cross-section and being wound in the direction opposite to the rotational direction of the motor shaft such that the coil spring transmits torque between the motor shaft and first gear.

2. An electric power tool in accordance with claim 1, wherein the coil spring has an inner diameter slightly smaller than the diameter of the first section of the motor shaft and the gear shaft of the first gear such that the first section is connected to the gear shaft by the winding force of the coil spring while the motor is inoperative.

3. An electric power tool in accordance with claim 2, wherein the tool further comprises a housing, a bearing for supporting the motor shaft, the bearing having an outer surface and being disposed in a portion of the housing, a cylindrical elastic ring which is disposed between the bearing and said portion of the housing and which includes an inner surface and at least one protrusion provided on the inner surface, the at least one protrusion pressing the outer surface of the bearing when the elastic ring is disposed in place.

4. An electric power tool in accordance with claim 1, wherein the midpoint of the coil spring is located at the connection of the first section of the motor shaft and the gear shaft of the first gear, such that half the winding of the coil spring covers the first section and the other half of the winding covers the gear shaft.

5. An electric power tool in accordance with claim 4, wherein the tool further comprises a housing, a bearing for supporting the motor shaft, the bearing having an outer surface and being disposed in a portion of the housing, a cylindrical elastic ring which is disposed between the bearing and said portion of the housing and which includes an inner surface and at least one protrusion provided on the inner surface, the at least one protrusion pressing the outer surface of the bearing when the elastic ring is disposed in place.

6. An electric power tool in accordance with claim 1, wherein the coil spring has an approximately square cross section.

7. An electric power tool in accordance with claim 6, wherein the tool further comprises a housing, a bearing for supporting the motor shaft, the bearing having an outer surface and being disposed in a portion of the housing, a cylindrical elastic ring which is disposed between the bearing and said portion of the housing and which includes an inner surface and at least one protrusion provided on the inner surface, that at least one protrusion pressing the outer surface of the bearing when the elastic ring is disposed in place.

8. An electric power tool in accordance with claim 1, wherein the motor shaft further includes a free end and a second section which has a diameter smaller than that of the first section and is terminated at the free end, and further wherein the first gear further includes an axial bore having approximately the same inner diameter as the diameter of the second section of the motor shaft so as to allow the first gear to be freely rotatably provided around the second section of the motor shaft at the free end of the motor shaft.

9. An electric power tool in accordance with claim 8, wherein the first gear further includes a tooth section having a diameter larger than that of the gear shaft, and further wherein the tool further comprises a means for limiting movement of the coil spring in one axial direction of the spring, the coil spring fitted between the limiting means and the tooth section, thus prohibiting the axial movement of the coil spring in either direction.

10. An electric power tool in accordance with claim 9, wherein the means for limiting is a side surface of the bearing.

11. An electric power tool in accordance with claim 8, wherein the tool further comprises a housing, a bearing for supporting the motor shaft, the bearing having an outer surface and being disposed in a portion of the housing, a cylindrical elastic ring which is disposed between the bearing and said portion of the housing and which includes an inner surface and at least one protrusion provided on the inner surface, the at least one protrusion pressing the outer surface of the bearing when the elastic ring is disposed in place.

12. An electric power tool in accordance with claim 1, wherein the tool further comprises a housing, a bearing for supporting the motor shaft the bearing having an outer shaft surface and being disposed in a portion of the housing, a cylindrical elastic ring which is disposed between the bearing and said portion of the housing and which includes an inner surface and at least one protrusion provided on the inner surface, the at least one protrusion pressing the outer surface of the bearing when the elastic ring is disposed in place.

13. An electric power tool in accordance with claim 12, wherein the at least one protrusion of the elastic ring is a circular ridge formed around the inner surface of the elastic ring.

14. An electric power tool in accordance with claim 13, wherein said portion of the housing is a stepped recess for seating the elastic ring and the bearing.

15. An electric power tool in accordance with claim 14, wherein the housing comprises first and second casings divided at a position where the stepped recess is exposed, with the stepped recess being provided in the first casing and the second casing covering the stepped recess except where the motor shaft penetrates when assembled to the first casing.

16. An electric power tool in accordance with claim 1, wherein the first gear is a pinion gear and the second gear is a bevel gear, and further wherein the motor shaft is oriented orthogonal to the spindle.

17. An electric power tool in accordance with claim 16, wherein the tool is a grinder further comprising a grinding wheel attached to a free end of the spindle outside the housing.

18. An electric power tool, comprising:

a housing;

a motor having a motor shaft which is rotatable in a predetermined direction and includes a first section;

a bearing for supporting the motor shaft, the bearing having an outer surface and being disposed in a portion of the housing;

a first gear freely rotatable provided on the motor shaft, the first gear including a gear shaft which coaxially opposes the first section of the motor shaft and which has approximately the same diameter as that of the first section;

a second gear provided on a spindle, the second gear engaging the first gear in order to transmit torque from the motor to the spindle;

a coil spring wound around the first section of the motor shaft and the gear shaft of the first gear, the coil spring being wound in the direction opposite to the rotational direction of the motor shaft such that the coil spring transmits torque between the motor shaft and first gear; and a cylindrical elastic ring which is disposed between the bearing and said portion of the housing and which includes an inner surface and at least one protrusion provided on the inner surface, that at least one protrusion pressing the outer surface of the bearing when the elastic ring is disposed in place.

19. An electric power tool, comprising:

a motor having a motor shaft which is rotatable in a predetermined direction and includes a first section;

a first gear freely rotatably provided on the motor shaft, the first gear including a gear shaft which coaxially opposes the first section of the motor shaft and which has approximately the same diameter as that of the first section;

a second gear provided on a spindle, the second gear engaging the first gear in order to transmit torque from the motor to the spindle; and a coil spring wound around the first section of the motor shaft and the gear shaft of the first gear, the coil spring being wound in the direction opposite to the rotational direction of the motor shaft such that the coil spring transmits torque between the motor shaft and first gear;

wherein the midpoint of the coil spring is located at the connection of the first section of the motor shaft and the gear shaft of the first gear, such that half the winding of the coil spring covers the first section and the other half of the winding covers the gear shaft.

20. An electric power tool, comprising:

a motor having a motor shaft;

a housing;

a bearing for supporting the motor shaft, the bearing having an outer surface and being disposed in a portion of the housing; and a cylindrical elastic ring which is disposed between the bearing and said portion of the housing and which includes an inner surface and at least one protrusion provided on the inner surface, the at least one protrusion pressing the outer surface of the bearing when the elastic ring is disposed in place.

* * * * *

UNITED STATES PATENT AND TRADEMARK OFFICE

CERTIFICATE OF CORRECTION

PATENT NO. : 6,277,013 B1 
DATED : August 21, 2001
INVENTOR(S) : Katsuhiko Sasaki, Toru Itakura and Shin Sugiura It is certified that error appears in the above-identified patent and that said Letters Patent is hereby corrected as shown below:

Column 14,
Line 18, replace “that” with -- the --
Line 56, replace “shaft surface” with -- surface --

Column 15,
Line 26, replace “rotatable” with -- rotatably --

Column 16,
Line 2, replace “that” with -- the --.

Signed and Sealed this

Second Day of July, 2002

*Attest:*

*Attesting Officer*

JAMES E. ROGAN
*Director of the United States Patent and Trademark Office*